US009702159B2

(12) United States Patent
Meirer et al.

(10) Patent No.: US 9,702,159 B2
(45) Date of Patent: Jul. 11, 2017

(54) DEVICE AND METHOD FOR AUTOMATICALLY LATERALLY STORING A MOTOR VEHICLE IN A STORING DEVICE

(75) Inventors: Leopold Meirer, Unterwoessen (DE); Rupert Koch, Munich (DE); Tomas Cary Bellaflor, Munich (DE)

(73) Assignee: SERVA TRANSPORT SYSTEMS GMBH, Grabenstaett (DE)

( * ) Notice: Subject to any disclaimer, the term of this patent is extended or adjusted under 35 U.S.C. 154(b) by 428 days.

(21) Appl. No.: 13/989,911

(22) PCT Filed: Nov. 29, 2011

(86) PCT No.: PCT/EP2011/005983

§ 371 (c)(1),
(2), (4) Date: Jul. 8, 2013

(87) PCT Pub. No.: WO2012/072236

PCT Pub. Date: Jun. 7, 2012

(65) Prior Publication Data

US 2013/0280018 A1 Oct. 24, 2013

(30) Foreign Application Priority Data

Nov. 29, 2010 (DE) ..... 10 2010 052 850

(51) Int. Cl.
*E04H 6/30* (2006.01)
*E04H 6/18* (2006.01)

(52) U.S. Cl.
CPC ..... *E04H 6/305* (2013.01); *E04H 6/183* (2013.01)

(58) Field of Classification Search
CPC ..... E04H 6/183; E04H 6/305
(Continued)

(56) References Cited

U.S. PATENT DOCUMENTS 2,773,614 A * 12/1956 Edwards et al. ..... B61D 47/005 414/256
2,846,186 A * 8/1958 Smith ..... E04H 6/183 414/256

(Continued)

FOREIGN PATENT DOCUMENTS

DE 3909702 A1 9/1990
DE 4216457 A1 11/1993

(Continued)

OTHER PUBLICATIONS

The International Search Report and the Written Opinion issued in connection with PCT Application No. PCT/EP2011/005983, mailed on Apr. 10, 2012.

(Continued)

*Primary Examiner* — James Keenan
(74) *Attorney, Agent, or Firm* — Gesmer Updegrove LLP

(57) ABSTRACT

Device for storing an automotive vehicle transversely relative to its longitudinal axis on a parking space of a storage facility, having a surface-manoeuvrable, driverless vehicle transporter which is disposed parallel to the longitudinal axis of the automotive vehicle when receiving the automotive vehicle and has horizontally extending pairs of forks which are disposed thereon at one side and perpendicularly, the forks of the pairs of forks being displaceable individually horizontally along the vehicle transporter and the pairs of forks moving under wheels respectively of a vehicle axle from one side of the automotive vehicle in order to grip the wheels by displacing the individual forks horizontally towards each other, whereupon the automotive vehicle is lifted for transporting, surface-manoeuvrable supports (4) being disposed on the vehicle transporter (1) respectively at the end-side, which supports extend horizontally and parallel to the pairs of forks (3) and, when the pairs of forks (3) move under the wheels (8), move past the automotive
(Continued)

Figure 1:
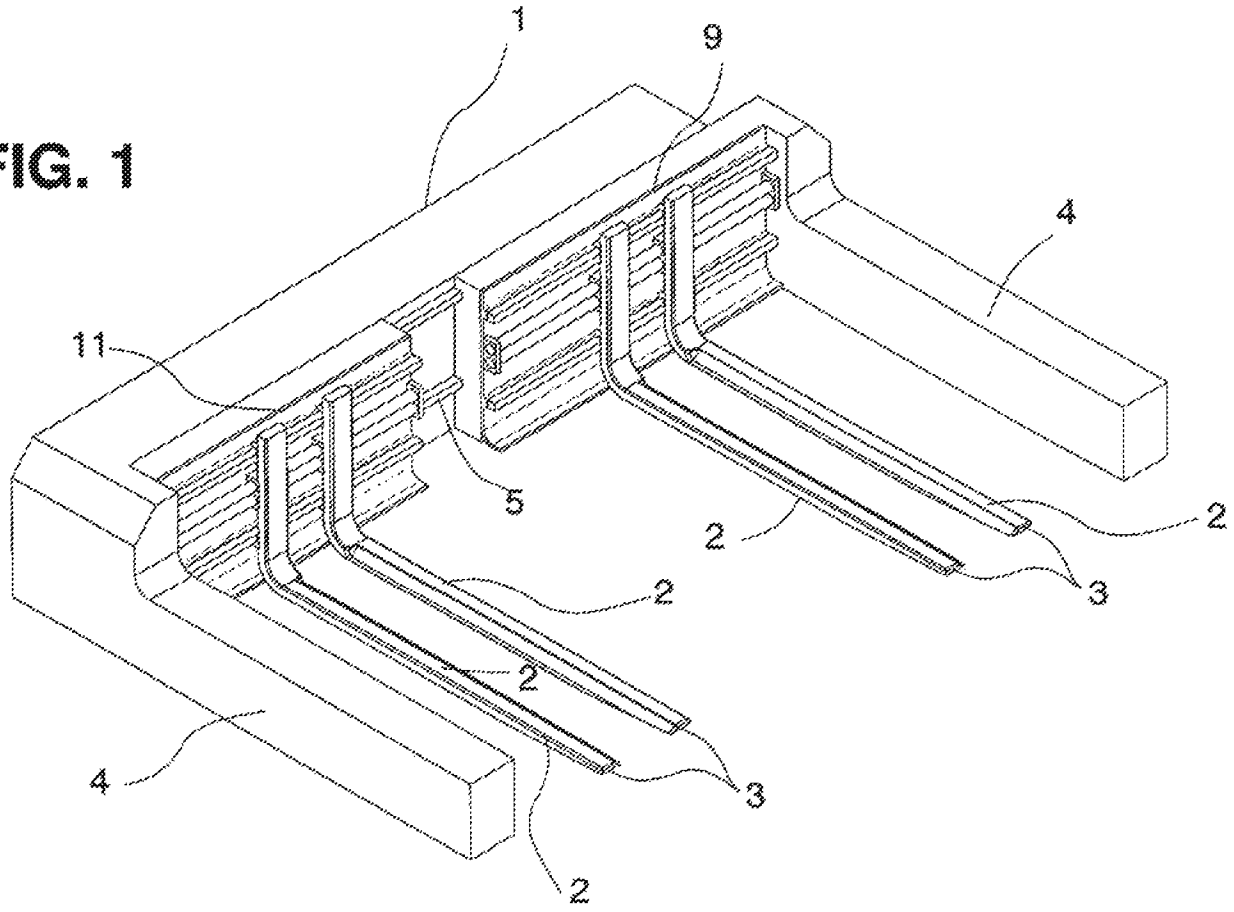

vehicle (7) at the front- and rear-side at a small spacing, the spacing between the supports (4) being adjustable, a measuring device (6), before the automotive vehicle (7) is received, determining its length, axle positions and the position of the automotive vehicle (7) in space, the surface-manoeuvrable, driverless transporting means (1) adapting, with the data transmitted from the measuring device (6), its length determined by the spacing of the supports (4) and the position of the pairs of forks (3) automatically to the dimensions of the automotive vehicle (7) to be received, and the load absorbed upon lifting the automotive vehicle (7) being transmitted, on the one hand, by the vehicle transporter (1) and, on the other hand, by the surface-manoeuvrable supports (4) to the travel surface.

6 Claims, 5 Drawing Sheets

(58) Field of Classification Search
USPC ..... 414/255, 256, 260, 264, 429, 667
See application file for complete search history.

(56) References Cited

U.S. PATENT DOCUMENTS 2,847,131 A * 8/1958 Miller ..... E04H 6/183 414/264
2,899,087 A 8/1959 Jacobsen
2,930,496 A * 3/1960 Wheeler ..... E04H 6/186 414/240
3,011,660 A * 12/1961 Shutt ..... E04H 6/183 414/255
3,038,621 A * 6/1962 Mitchell ..... E04H 6/183 414/429
3,091,349 A * 5/1963 Roth ..... E04H 6/183 414/256
3,435,965 A * 4/1969 Scharf et al. ..... E04H 6/183 414/259
3,954,198 A * 5/1976 Sedelmayer ..... B66F 5/04 414/429
4,968,208 A * 11/1990 Friberg ..... E04H 6/183 414/256
4,971,506 A * 11/1990 Givati ..... E04H 6/22 414/228
5,067,869 A * 11/1991 Reuss et al. ..... B60P 3/07 414/255
5,286,156 A * 2/1994 Ikenouchi et al. ..... E04H 6/183 414/253
5,320,473 A * 6/1994 Arnold et al. ..... E04H 6/183 414/253
5,667,352 A * 9/1997 Curtin ..... B66F 9/07522 414/667
5,863,171 A * 1/1999 Engman ..... E04H 6/183 414/256
5,893,696 A * 4/1999 Belinsky ..... E04H 6/225 414/253
7,461,733 B2 * 12/2008 Dohi ..... B62D 65/18 198/345.1
8,632,290 B2 * 1/2014 Alan ..... E04H 6/183 414/231
2011/0091306 A1 * 4/2011 Roux ..... B66F 9/07563 414/667

FOREIGN PATENT DOCUMENTS

DE 102006053528 A1 12/2007
FR 1437539 A 5/1966
JP 06191798 A * 7/1994 ..... B66F 9/075
JP H10505392 A 5/1998
JP 2003343111 A 12/2003
JP 2009287235 A 12/2009
KR 20070113190 A 11/2007
WO 2004045932 A1 6/2004

OTHER PUBLICATIONS

Japanese Office Action Issued in Corresponding Patent Application No. 2013-540271 Issued on Jun. 9, 2015.
English translation of the International Preliminary Report on Patentability issued in connection with corresponding PCT Application No. PCT/EP2011/005983 mailed on Jun. 13, 2013.
Israeli Office Action issued in Israeli Patent Application No. 226550 dated Feb. 13, 2017.

* cited by examiner

DEVICE AND METHOD FOR AUTOMATICALLY LATERALLY STORING A MOTOR VEHICLE IN A STORING DEVICE

PRIORITY INFORMATION

The present invention is a 371 National Phase Application of PCT/EP2011/005983, filed on Nov. 29, 2011 that claims priority to German Application No. 102010052850.1 filed on Nov. 29, 2010, which are incorporated herein by reference in their entireties.

BACKGROUND OF THE INVENTION

The invention relates to a device and a method for automatic storage of an automotive vehicle transversely relative to its longitudinal axis on a parking space of a storage facility.

In the case of known automatic multi-storey car parks, transport robots installed in a fixed manner or systems based on pallets are used in order to park vehicles automatically. It proves to be difficult to lift and to transport vehicles from a parking area since the ground clearance of vehicles only makes available a small space for transport machines. The most varied of vehicle sizes are found in current road traffic: small cars with a very small wheelbase but also vehicles, such as for example top-of-the-range SUVs, with a maximum wheelbase. This makes parking with an automatic system difficult and leads to a multi-storey car park which is not utilised efficiently since the markedly different vehicles are parked on parking spaces of the same size.

The difference in length between small cars and top-of-the-range vehicles, in the case of standard models, is up to 3,500 mm. In known automatic car parks—as described in KR 20070113190 A—no or only very little consideration can be given to the different vehicle sizes. Systems based on pallets have a standard pallet size and are generally designed such that they only park vehicles up to 5,000 mm length in order to achieve a certain efficiency. Automatic parking systems which—as described in WO 2004 045932 A1—receive vehicles in the direction of travel (longitudinal direction) cannot park vehicles in parking spaces of different sizes since the length of the transport system corresponds to the maximum length of the vehicles to be parked. Even in the case of receiving mechanisms which consist of two receiving trucks—as described in US 2899087 A or in DE 3909702 A1—parking on parking spaces of different sizes is only possible to a very small extent. Therefore, this is not applied in known automatic parking systems since problems with respect to construction technology make it impossible to design the receiving trucks to be so small that they can park vehicles precisely bumper to bumper. Furthermore, known parking systems with receiving trucks can park at most 2 vehicles in a row. Since the vehicle sizes vary so greatly, it is therefore also impossible with this solution to park vehicles really efficiently.

A further problem of the currently known automatic car parks is that a machine unit in one system section is responsible for approx. 40 to 80 vehicles. In an automatic multi-storey car park of 300 parking spaces, 4 system areas which are operated by respectively one machine unit are hence produced. This means that, in the case of a system failure, a parked vehicle in the corresponding area of responsibility of the machine cannot be accessed since either the pallet, the vehicle receiving mechanisms or the conveying lift blocks the system. It is possible in none of the known systems to request a further machine from a different system section in order to retrieve the vehicles.

Furthermore, it is not possible in the case of known automatic car parks that a plurality of pallets or vehicle receiving mechanisms work together in parallel operation in the same system section if for example a plurality of vehicles is requested at the same time from the same system section. The vehicles cannot therefore be retrieved in parallel as fast as possible. This is not possible since the machines are constructionally tied to their position, i.e. generally by a linear guide.

In the case of known automatic parking garages, vehicles cannot be retrieved manually in the case of complete plant failure. Neither vehicles which are situated on a pallet nor vehicles which have been stored by receiving mechanisms in a stacked storage system made of steel or concrete can be moved.

Known parking systems also cannot be incorporated in already existing multi-storey car parks without great constructional complexity. In the case of the known systems, no significantly improved degree of surface utilisation is achieved even with complex conversion of a traditional car park into an automatic car park since the vehicles—as explained already—cannot be parked corresponding to their size.

Furthermore, no communication between customer and the parking system takes place with currently known parking systems. The only contact with the customer takes place anonymously at the payment machine.

In a known device according to DE 42 16 457 C2, gripping arms which can be extended horizontally and perpendicularly to the direction of travel of the conveying means and moved under the automotive vehicle are fitted. The gripping arms which are fitted parallel can be extended in the manner of a telescope and can be extended on both sides of the conveying means. The conveying means can be moved horizontally or vertically. It is difficult with this type of conveying means to park a plurality of vehicles adjacently in the transverse direction since the gripping arms, in the case of three parallel-parked vehicles, would have to extend approx. 6,600 mm. It is also difficult with gripping arms which are far extended to absorb the load caused by the received vehicle at the end of the telescope-like gripping arms. Lifting the automotive vehicle is effected there solely by the gripping of the gripping arms, which are moved towards each other, on the wheel tyres. For transport, the automotive vehicle is deposited on a depositing area of the conveying means.

SUMMARY OF THE INVENTION

The problem underlying the invention is to store heavy automotive vehicles transversely relative to their longitudinal axis on parking spaces of a storage facility several rows deep and thereby to waste as little space as possible in front of and behind the automotive vehicle and thereby to ensure maneuverability over the surface and, at the same time, stability of the transporting means.

This problem is resolved by surface-manoeuvrable supports being disposed on the transporting means respectively at the end-side, which supports extend horizontally and parallel to the pairs of forks and, when the pairs of forks move under the wheels, move past the automotive vehicle at the front- and rear-side at a small spacing, by the spacing between the supports being adjustable, by a measuring device, before the automotive vehicle is received, determining its length, axle positions and the position of the automotive vehicle in space, by the surface-manoeuvrable, driverless transporting means adapting, with the data transmitted from the measuring device, its length determined by the spacing of the supports and the position of the pairs of forks automatically to the dimensions of the automotive vehicle to be received, and by the load absorbed upon lifting the automotive vehicle being transmitted, on the one hand, by the transporting means and, on the other hand, by the surface-manoeuvrable supports to the travel surface.

Advantageously, the transporting means is disposed, upon receiving the automotive vehicle, with a longitudinal direction parallel to a longitudinal axis of the automotive vehicle, the longitudinal direction of the transporting means being that direction which is perpendicular to the forks and the supports and parallel to the travel surface. The longitudinal direction of the automotive vehicle may be that direction in which the automotive vehicle is travelling if it is travelling straight on. Advantageously, the transporting means, when receiving the automotive vehicle, is disposed next to the automotive vehicle.

The pairs of forks are disposed on the transporting means at one side, which means that they are disposed and/or mounted only at one side of the transporting means. Preferably, all the forks of all the pairs of forks extend from the point of their mounting in the same direction.

The pairs of forks move under the wheels of the automotive vehicle, preferably only from one side, namely in that direction in which the forks extend from their mounting point on the transporting means.

The advantages achieved with the invention reside in particular in storing automotive vehicles with optimised surface area. This advantage results in particular by storage, several rows deep, transversely relative to the direction of travel and the storage of the automotive vehicle in rows of parking spaces of different sizes. As a result, a minimum spacing between the vehicles is guaranteed and hence the vehicle lengths which are nowadays significantly different are taken into account during parking. Furthermore, parallel operation in the automatic parking system is possible due to the surface-maneuverable driverless transporting means; since, for example in comparison with stacked storage, travel can take place simultaneously in a plurality of levels and with a plurality of driverless transporting means simultaneously on one level. As a result of the stability of the surface-maneuverable driverless transporting means, no guides, such as e.g. rails on the ground of the storage facility, are required, which has an advantageous effect on the flexibility of the system.

DETAILED DESCRIPTION OF THE ILLUSTRATED EMBODIMENTS

Figure 2:
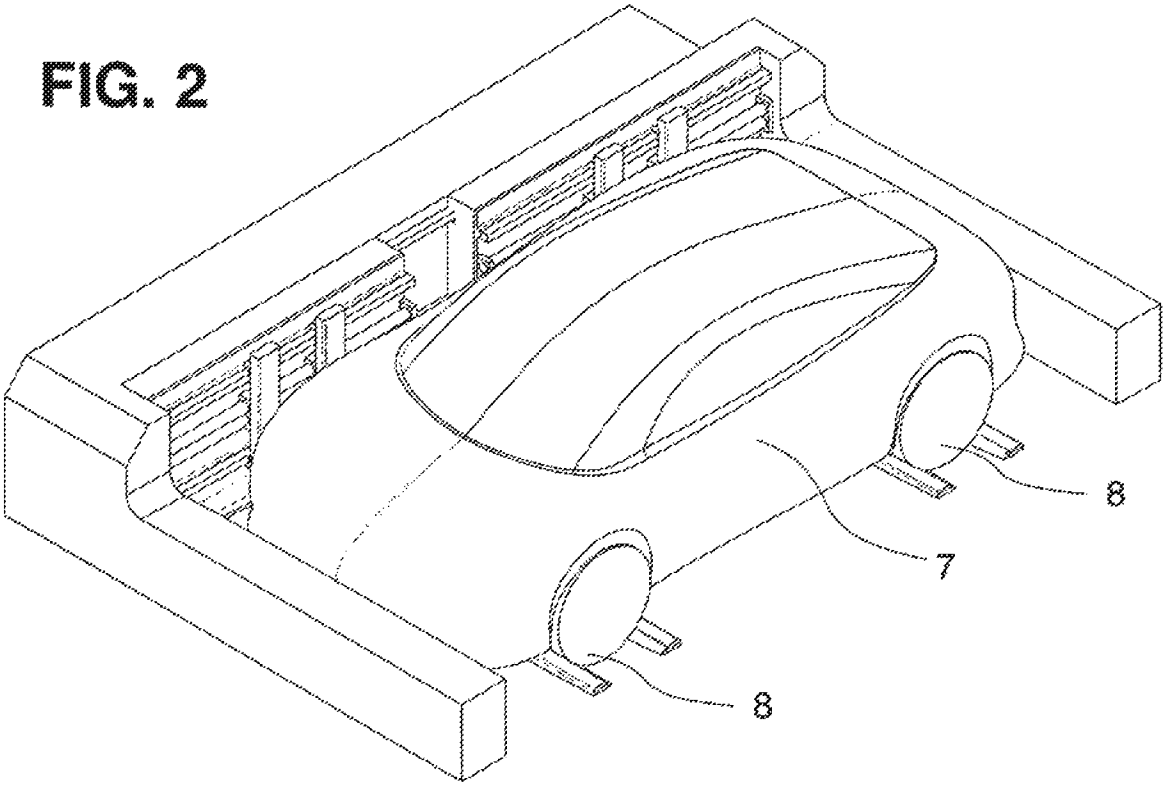
Figure 3:
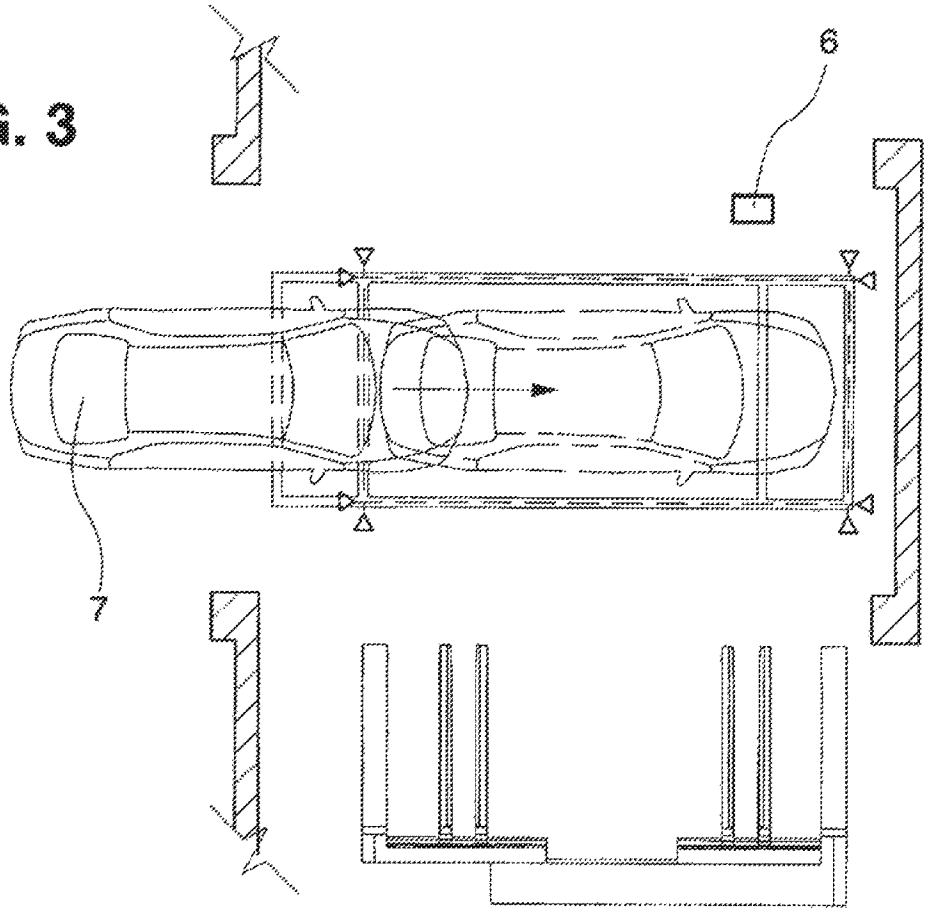

An embodiment of the invention is explained in more detail with reference to the drawing. There are shown:

FIG. 1: A plan view of the surface-maneuverable driverless transporting means FIG. 2: A plan view of the surface-maneuverable driverless transporting means with a received automotive vehicle FIG. 3: A plan view of the transfer station FIG. 4: A plan view of the storage facility FIG. 5: A plan view of the surface-maneuverable transporting means with a beam as device for length adjustment The surface-maneuverable driverless transporting means (1), represented in FIGS. 1 to 3, has, at its ends which are parallel next to the pairs of forks (3), surface-maneuverable supports (4), which, in addition to the transporting means, absorb a part of the load caused by the automotive vehicle (7) and prevent tilting. The pairs of forks (3) are mounted, on one side, on the surface-maneuverable driverless transporting means (1) and can be displaced individually and, on the other side are self-supporting. In order now to be able to receive automotive vehicles (7) of different lengths with the surface-maneuverable driverless transporting means (1), the spacing between the supports (4) on the surface-maneuverable driverless transporting means (1) is adjustable in length by a displacement mechanism (5), e.g. a linearly guided, electrically operated spindle, and hence, before receiving the automotive vehicle (7), can be adapted to the length thereof. The surface-maneuverable supports (4) are fixed rigidly on the surface-maneuverable driverless transporting means (1) on one side after the adjustment process and transfer the load to the ground via a surface-maneuverable mechanism, e.g. rollers or wheels, which can have a pivotable configuration.

Figure 4:
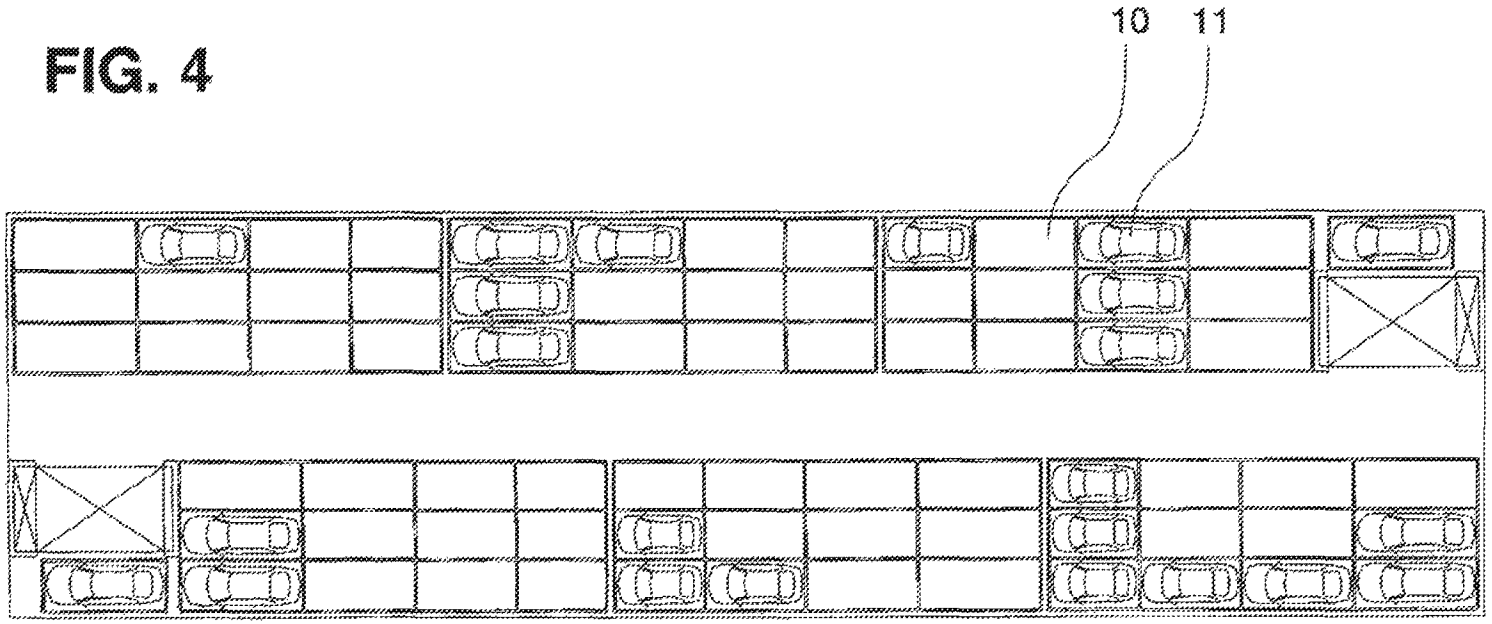

The length, the axle positions and the position of the automotive vehicle (7) in space are determined by a measuring device (6). Also the front and rear overhang of the automotive vehicle (7) are thereby determined. The surface-maneuverable driverless transporting means (1) receives information about the length and axle position of the automotive vehicle (7) to be received from the measuring device (6), and now adapts its length via the displacement unit (5) and the positions of the forks (2) to the automotive vehicle (7) to be parked and moves the pairs of forks (3) under the automotive vehicle (7). This is particularly advantageous since, as a result of the length adaptation of the surface-maneuverable driverless transporting means (1) during storage of the automotive vehicle (7), as illustrated in FIG. 4, it can be moved into parking spaces (10 and 11) of different sizes. It is particularly advantageous for optimum utilisation of the area of the parking system to deposit automotive vehicles (7) of the same length category on the parking space rows (11) transversely to the direction of travel of the vehicle. The two surface-maneuverable supports (4) respectively move past the automotive vehicle (7) at. This is particularly advantageous since also heavy automotive vehicles can hence be received and, at the same time, little space is required to the left and right next to the automotive vehicle (7) during storage transversely relative to the direction of travel. The two pairs of forks (3), in the open state, move respectively under the automotive vehicle (7) to the left and right next to the tyres (8). After moving under the automotive vehicle (7) from the side, the two pairs of forks (3) are moved into contact with the tyres (8), e.g. by respectively one electrically actuated spindle which is mounted with a linear guide. The automotive vehicle (7) is subsequently lifted by respectively one lifting unit (9), e.g. an electrical spindle lifter, on which respectively one pair of forks (3) is fitted, and is transported to its parking space (10) which is defined by the length of the automotive vehicle (7).

The surface-maneuverable driverless transporting means (1) moves moveably over the surface, after receiving the automotive vehicle (7), and hence is not fixed constructionally and can therefore move freely between the system areas, e.g. different levels of a car park. A plurality of surface-maneuverable driverless transporting means (1) can operate in parallel in this way within one system area. This is particularly advantageous since, by using a plurality of driverless transporting means, shorter waiting times result for retrieving and storing automotive vehicles (7), even if the automotive vehicles (7) are requested from the same system area at the same time. The driverless transporting means can accomplish the retrieval process of n automotive vehicle (7) in 1 . . . n rows of parking spaces, 1 . . . n parking space gaps and in 1 . . . n levels in coordinated cooperation. Central control allocates corresponding tasks and navigates the individual automotive vehicle (7) with the surface-maneuverable driverless transporting means (1) in succession to a calculated parking space (10) of a specific row of parking spaces. The surface-maneuverable driverless transporting means (1) can be transported by a known lift including the automotive vehicle (7) from level zero to level n. In one system area, n lifts can be available, which transport the surface-maneuverable driverless transporting means (1) with or without an automotive vehicle (7) between the n levels.

Likewise, it is advantageous that, in the case of a system disruption or a system failure of a surface-maneuverable driverless transporting means (1), outstanding transporting tasks in one system area can be taken over by surface-maneuverable driverless transporting means (1) of the same or of a different system area.

When receiving automotive vehicles (7) transversely relative to the direction of travel, it is advantageous that the surface-maneuverable driverless transporting means (1) can be adjusted, in order to adapt the spacing between the supports (4) to the length of the automotive vehicle (7), by a displacement unit (5). Likewise, it is very advantageous that the automotive vehicles (7) can be received directly from parking areas with the help of the pairs of forks (3) and can be deposited correspondingly directly on parking areas.

Before the automotive vehicle (7) is received by the surface-maneuverable driverless transporting means (1), it is measured by a measuring unit (6) and assigned to the different length categories. The parking spaces (10 and 11) are disposed transversely relative to the direction of travel in 1 . . . n rows of parking spaces for different vehicle lengths and 1 . . . n parking space gaps. The automotive vehicles (7) are deposited in 1 . . . n rows of parking spaces and 1 . . . n parking space gaps. Corresponding to the length category and taking into account visitor profiles and the parking duration, a parking space (10) is assigned to the automotive vehicle (7). The surface-maneuverable driverless transporting means (1) transports the automotive vehicle (7) to the defined parking space (10) and deposits the automotive vehicle (7) transversely relative to the direction of travel of the automotive vehicle (7). It is favourable in particular to deposit the automotive vehicles (7) in the parking space gaps nose-to-tail in the direction of travel of the automotive vehicle (7). It is thereby also possible to deposit automotive vehicles (7) of smaller length categories on parking spaces (11) of the larger length categories.

For depositing the automotive vehicle, the method of receiving, as described above, is implemented in reverse sequence. The forks of the pairs of forks therefore release the wheels mutually by horizontal displacement of the individual forks (2). The horizontally extending pairs of forks are then withdrawn towards one side of the automotive vehicle (7), the surface-maneuverable supports (4) which are disposed respectively on one side moving past the automotive vehicle (7), when returning, at the front- and rear-side at a small spacing.

The retrieval process begins when the driver requests the automotive vehicle (7). This process is organised to be as user-friendly as possible: the driver requests his deposited automotive vehicle (7) for example via applications on mobile telephones, a customer centre, the payment terminal at the car park or web applications and stipulates a pick-up time so that the automotive vehicle (7) is available at the correct time. If the driver is a registered customer at the car park and if he has arranged an automatic debit for example, the driver is informed about the transfer station and the parking fee is automatically debited. If the parking fee has to be paid at the automatic car park, the automotive vehicle (7) is released for retrieval only when the parking fee has been paid.

When retrieving a parked vehicle, the surface-maneuverable driverless transporting means (1) receives instructions about collecting the automotive vehicle (7) deposited transversely relative to the direction of travel and transports the latter to the defined transfer station. The automotive vehicle (7) is deposited in the transfer station such that the driver can leave the transfer station in the direction of travel.

It is very advantageous in the case of the driverless transporting means (1) that these can be retrofitted even in already existing multi-storey car parks. A further advantage of this system is the parking and depositing of automotive vehicles on navigable parking areas, it is hence possible in a special situation to retrieve automotive vehicles (7) manually from the parking garage.

Figure 5:
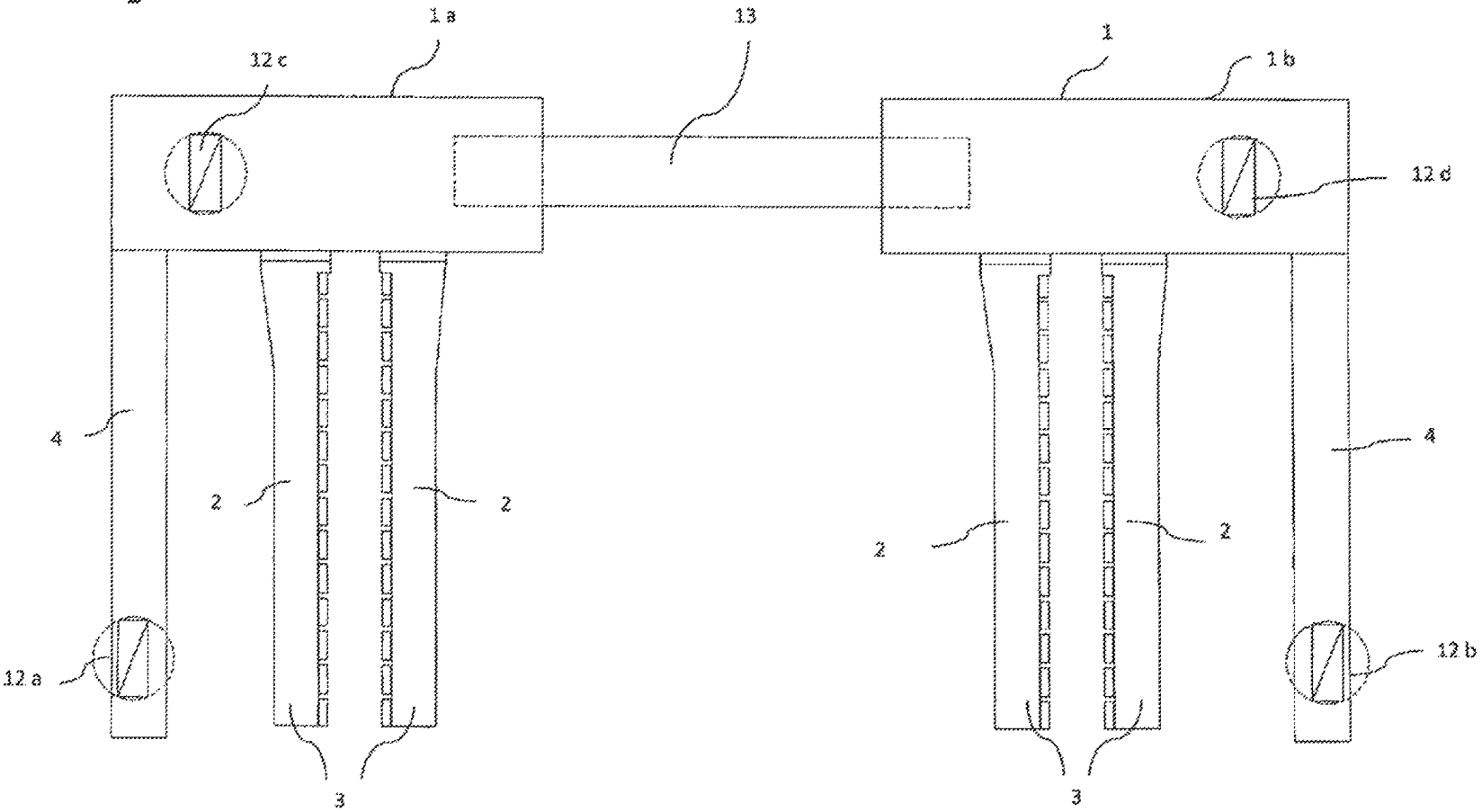

FIG. 5 shows a plan view on a driverless transporting means according to the invention, in which several advantageous developments of the invention are produced. The driverless transporting vehicle shown in FIG. 5 has four wheels (12*a*), 12*b*), (12*c*), (12*d*) which can be rotated advantageously by 360°.

In an advantageous embodiment, the driverless transporting means (1) has a beam (13) which is disposed between two main bodies (1*a*) and (1*b*) and enables a length adjustment of the total length of the driverless transporting vehicle (1). For this purpose, the beam (13) can be retracted into one of or both of the main body parts (1*a*) or (1*b*) of the driverless transporting vehicle (1), preferably until the main bodies (1*a*) and (1*b*) are in contact in the maximum retracted state. It is thereby advantageous if the beam can be retracted into both main bodies (1*a*) and (1*b*) to the same extent since consequently the greatest change in length in the overall length of the driverless transporting vehicle (1) can be achieved.

For changing the length by displacement of the main bodies (1*a*) and (1*b*) relative to each other, a toothed belt, which is not shown in the Figure, can be fitted on the beam (13) and can be actuated by a motor. Particularly advantageously, the motor can be driven in instantaneous operation so that it compensates precisely for the occurring frictional forces on the linear guides. This means that the beam can be moved without resistance and without additional forces arising. The toothed belt can hereby be connected rigidly to the main body respectively on one side. Alternatively, instead of the toothed belt, also racks, spindles or Bowden cables can be used in order to effect the length change.

The solution of driving the motor for adjusting the length in instantaneous operation makes it possible to change the length by actuating the two main bodies (1*a*) and (1*b*) via their respective wheels (12*a*), (12*b*), (12*c*) and (12*d*) differently in the direction of a longitudinal direction of the beam (13). As a result, the main bodies (1*a*) and (1*b*) can be moved towards each other or away from each other. The change in length can be produced even completely without a drive on the beam (13). In this case, the forces occurring on the guide of the beam (13) can likewise be compensated for by a different drive of the wheels of the two main bodies (1*a*) and (1*b*).

Of the illustrated wheels, those two wheels (12*c*) and (12*d*) can be actuated respectively in the main bodies (1*a*) or (1*b*). The steering of the wheels can also be actuated actively via a steering motor on the respective wheel. The wheels (12*a*) and (12*b*) on the extension arms (4) can be passive and freely rotatable, however they can also be actively actuatable. This independent controllability of the wheels enables the above-described change in length.

Driving maneuvres can be implemented for example with the driverless transporting vehicle (1) according to the invention, as follows. In transverse travel, i.e. during travel in the direction of a motorcar disposed next to the transporting vehicle (1), for example for receiving a motorcar, two or four of the wheels (12*a*) to (12*d*) can be displaced actively such that the two main bodies (1*a*) and (1*b*) of the driverless transporting vehicle move towards each other and hence the result is a length adjustment of the vehicle (1). Preferably at least two wheels, which are situated one opposite the other or crosswise, are hereby intended to be actuated. Two further wheels can align themselves passively. Also actuation of all the wheels is possible. At the beginning of the transverse travel, all the wheels (12*a*) to (12*d*) are positioned parallel to each other, during travel the wheels can now be rotated towards each other at the same angle but in the opposite direction. As a result, the two main bodies (1*a*) and (1*b*) move apart or towards each other in order to adapt to the length of the vehicle.

When moving in the longitudinal direction, i.e. for example when a motorcar is received in the direction of travel of the motorcar, the driverless transporting vehicle (1) can likewise be adjusted in length by various maneuvres. For example, during travel, one of the main drives of one of the wheels (12*c*) to (12*d*) can travel somewhat more slowly or somewhat faster than the other wheels so that the two main bodies (1*a*) and (1*b*) move at different speeds and therefore move relative to each other. The result is therefore an adjustment in length. However, it is also possible to adjust the length from the stationary state by either travelling with the two main drives of the wheels (12*c*) and (12*d*) in the opposite direction or one of the wheels (12*c*) or (12*d*) remaining stationary whilst the other wheel is moved towards the latter or away from it.

Since the vehicle is surface-maneuverable, also further travel maneuvres are possible which lead to a change in the length of the driverless transporting vehicle (1). Basically it is possible to adjust the length during any travelling maneuvre by actuating the wheels such that either the speed is changed or the trajectories of the wheels are moved towards each other or away from each other.

The application of the invention is not restricted to automatic multi-storey car parks for parking the automotive vehicles of road users. Also the application for space-saving interim storage and preparation in the context of the production and sales of automotive vehicles is advantageous.

What is claimed is:

1. A device for storing an automotive vehicle transversely relative to its longitudinal axis on a parking space of a storage facility, the device having a surface-maneuverable, driverless transporting means with a longitudinal axis which is configured to be disposed parallel to the longitudinal axis of the automotive vehicle, the transporting means having horizontally extending pairs of forks which are disposed on one side of the transporting means perpendicularly to the longitudinal axis thereof, the forks of the pairs of forks being displaceable individually horizontally along the longitudinal axis of the transporting means and the pairs of forks respectively configured to move under wheels of a vehicle axle from one side of the automotive vehicle in order to grip the wheels by displacing the individual forks horizontally towards each other so as to lift the automotive vehicle for transporting, surface-maneuverable supports are disposed on the transporting means at end-sides of the transporting means, which supports extend horizontally and parallel to the pairs of forks and are arranged beside the pairs of forks, and the supports are disposed such that when the pairs of forks move under the wheels, the supports move past the automotive vehicle at its front- and rear-side, wherein the distance between the supports is adjustable, and a measuring device is configured to, before the pairs of forks are moved under the wheels of the automotive vehicle, determine and transmit data comprising a length and axle positions of the automotive vehicle, wherein the surface-maneuverable, driverless transporting means is configured to adjust, based on the data transmitted from the measuring device the distance between the supports and the position of the pairs of forks automatically to the length and axle positions of the automotive vehicle to be received, and wherein the transporting means and the surface-maneuverable supports are configured such that the load absorbed upon lifting the automotive vehicle is transmitted by the transporting means and by the surface-maneuverable supports to a travel surface, and wherein the transporting means and the supports have wheels which can be rotated by 360° about a vertical axis.

2. The device according to claim 1, wherein the surface-maneuverable driverless transporting means has at least one displacement unit for adapting the distance between the surface-maneuverable supports to the length of the automotive vehicle to be received.

3. The device according to claim 2, wherein a displacement unit is disposed between one of the supports and the transporting means for horizontal displacement of the support along the transporting means, and wherein the other support is connected rigidly to the transporting means.

4. The device according to claim 1 wherein the pairs of forks are configured to abut against the wheels by means of lifting units, one lifting unit for each pair of forks respectively being disposed on the transporting means, wherein the pairs of forks are configured to lift the automotive vehicle by vertical displacement of the pairs of forks.

5. A method for storing an automotive vehicle transversely relative to its longitudinal axis on a parking space of a storage facility comprising, moving horizontally extending pairs of forks which are disposed at one side on a surface-maneuverable, driverless transporting means, perpendicularly to a longitudinal axis of the driverless transporting means, under the automotive vehicle from a side of the automotive vehicle, each pair of forks respectively positioned at wheels of one vehicle axle, the forks of the pairs of forks gripping the wheels by displacing the individual forks horizontally towards each other, moving surface-maneuverable supports, which are disposed on the transporting means respectively at end-sides of the transporting means and which extend horizontally and parallel to the pairs of forks and which are arranged beside the pairs of forks, past the automotive vehicle at its front-and-rear-side while moving the forks of the pairs of forks under the wheels, the method further comprising, before moving the pairs of forks under the wheels of the automotive vehicle, determining and transmitting by a measuring device data comprising a length and axle positions of the automotive vehicle, and automatically adjusting with the data transmitted to the surface-maneuverable driverless transporting means, a distance between the supports, which is adjustable, and a position of the pairs of forks to the length and axle positions of the automotive vehicle, lifting the automotive vehicle, and transmitting the load absorbed upon lifting the automotive vehicle by the transporting means and by the supports to the travel surface, the transporting means and the supports having wheels which can be rotated by 360° about a vertical axis, and transporting the lifted automotive vehicle to a parking space of the storage facility and depositing it there.

6. The method according to claim 5, wherein lifting the automotive vehicle is effected by vertical displacement of the pairs of forks which abut on the wheels by means of lifting units which are disposed between each pair of forks and the transporting means.

* * * * *